US005682186A

United States Patent [19]

Bohorquez et al.

[11] Patent Number: 5,682,186

[45] Date of Patent: Oct. 28, 1997

[54] PROTECTIVE CAPPING APPARATUS FOR AN INK-JET PEN

[75] Inventors: Jaime H. Bohorquez, Escondido; Charles E. Schinner, San Diego, both of Calif.; John H. Dion, Corvallis, Oreg.; Arthur R. Hart, Corvallis, Oreg.; Niels J. Nielsen, Corvallis, Oreg.

[73] Assignee: Hewlett-Packard Company, Palo Alto, Calif.

[21] Appl. No.: 209,091

[22] Filed: Mar. 10, 1994

[51] Int. Cl.[6] ..... B41J 2/165

[52] U.S. Cl. ..... 347/29; 347/33; 347/44; 347/50; 347/87

[58] Field of Search ..... 347/29, 44, 31, 347/33, 49, 50, 87

[56] References Cited

U.S. PATENT DOCUMENTS

| | | | |
|---|---|---|---|
| 3,951,555 | 4/1976 | Wittnebert et al. | 401/217 |
| 4,371,881 | 2/1983 | Bork et al. | 347/44 |
| 4,401,990 | 8/1983 | Aiba et al. | 347/33 |
| 4,492,969 | 1/1985 | Terasawa | 347/30 |
| 4,543,589 | 9/1985 | Terasawa . | |
| 4,577,200 | 3/1986 | Rix et al. | 347/49 |
| 4,592,277 | 6/1986 | Dennese et al. | 101/38.1 |
| 4,646,111 | 2/1987 | Shimosato et al. | 347/44 |
| 4,684,963 | 8/1987 | Naka | 347/29 |
| 4,709,245 | 11/1987 | Piatt | 347/49 |
| 4,709,246 | 11/1987 | Piatt et al. | 347/87 |
| 4,709,247 | 11/1987 | Piatt et al. | 347/87 |
| 4,734,718 | 3/1988 | Iwagami et al. | 347/29 |
| 4,755,836 | 7/1988 | Ta et al. | 347/49 |
| 4,853,717 | 8/1989 | Harmon et al. | 347/29 |
| 4,952,947 | 8/1990 | Kyoshima | 347/30 |
| 4,970,535 | 11/1990 | Oswald et al. | 347/25 |
| 5,027,134 | 6/1991 | Harmon et al. | 347/29 |
| 5,051,761 | 9/1991 | Fisher et al. | 347/30 |
| 5,068,674 | 11/1991 | Sato et al. | 347/62 |
| 5,106,220 | 4/1992 | Ricca et al. | 346/145 |
| 5,214,447 | 5/1993 | Iwata | 347/31 |
| 5,289,213 | 2/1994 | Murai et al. | 347/44 X |
| 5,343,230 | 8/1994 | Dietl | 347/31 |
| 5,363,132 | 11/1994 | Ikkatai | 347/24 |
| 5,394,178 | 2/1995 | Grange | 347/33 |
| 5,444,474 | 8/1995 | Ohtsubo et al. | 347/87 |

FOREIGN PATENT DOCUMENTS

| | | | |
|---|---|---|---|
| 379151A3 | 7/1990 | European Pat. Off. . | |
| 0418828 | 9/1990 | European Pat. Off. | B41J 2/165 |
| 0495491 | 1/1992 | European Pat. Off. | B41J 2/165 |
| 0627317 | 5/1994 | European Pat. Off. | B41J 2/175 |
| 2457643 | 6/1976 | Germany | B41J 0/04 |
| U-8205426 | 10/1986 | Germany . | |
| 61-233544 | 10/1986 | Japan | 347/29 |
| 62-113560 | 5/1987 | Japan | 347/23 |
| 1-291947 | 11/1989 | Japan | 347/44 |
| 0245156 | 2/1990 | Japan | 347/33 |

OTHER PUBLICATIONS

IBM Technical Disclosure Bulletin, "Replaceable Ink Cartridge for Ink Jet Print Head," 34:459–462 (1991).

*Primary Examiner*—John E. Barlow, Jr.

[57] ABSTRACT

An ink pen is provided with a protective capping apparatus to protect against damage caused by the ingress of dirt and debris, the accumulation or solidification of ink, the discharge of static electricity or the like. The protective capping apparatus has a protective cap movable between an open position and a closed position. In the closed position the protective cap shields a portion of an ink pen such as the ink-jets or the electrical contacts.

14 Claims, 5 Drawing Sheets

FIG. 11
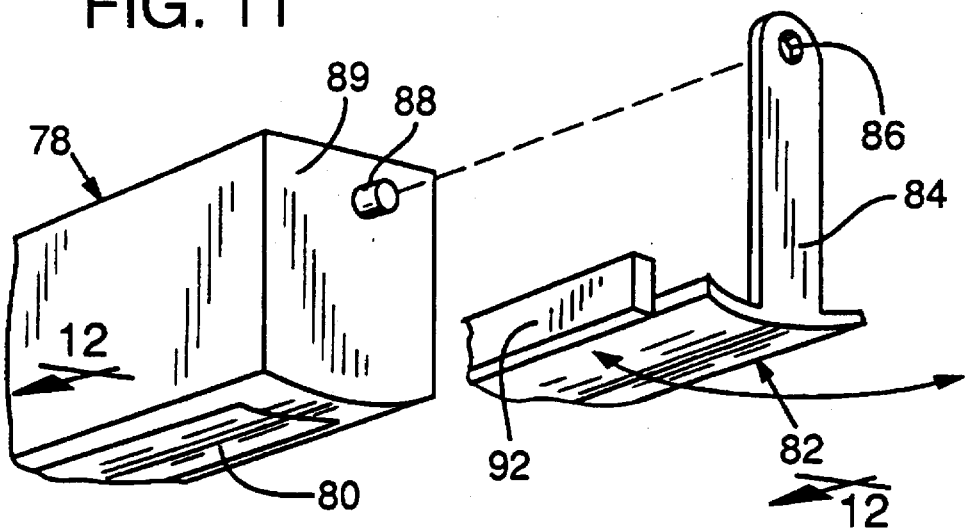
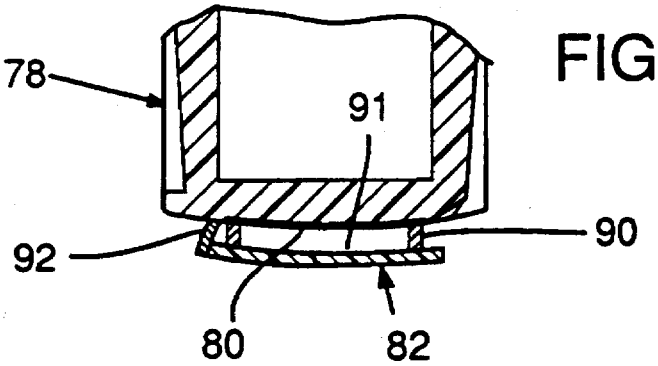
FIG. 12
FIG. 13
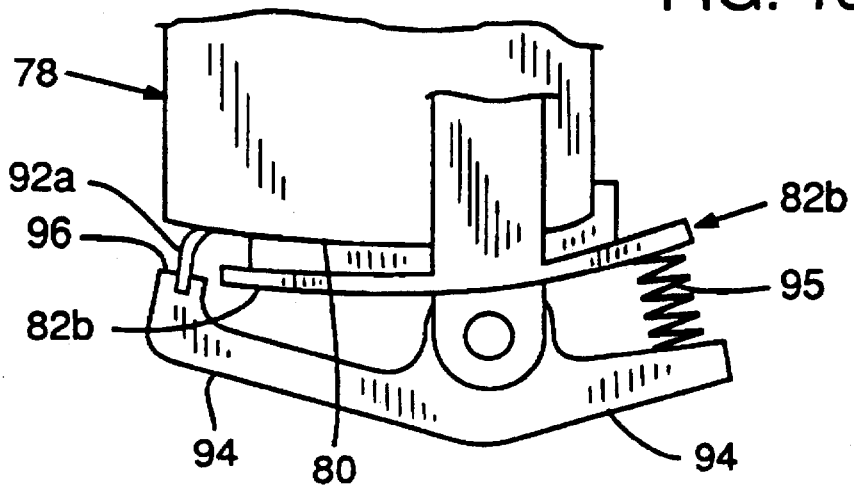

PROTECTIVE CAPPING APPARATUS FOR AN INK-JET PEN

BACKGROUND INFORMATION

The present invention relates to pens for ink-jet printers and, more particularly to a protective capping apparatus for such pens.

Ink-jet printers have become widely accepted as a reliable means of performing high quality printing. Such printers have one or more ink-jets which serve to eject, or jet, ink onto a printing medium to form desired characters or images. One type of ink-jet printer is a thermal ink-jet printer. In a typical thermal ink-jet printer, each thermal ink-jet has an orifice, a well for storing a small quantity of ink, and a thermal element such as a resistor. The thermal ink-jet is actuated by heating the thermal element to cause the small quantity of ink within the well to vaporize and be expelled through the orifice.

Ink-jet printers often employ ink pens. Such pens commonly have an ink reservoir for containing a supply of ink, a print head having an array of one or more ink-jets, and an electrical contact pad. The electrical contact pad has one or more electrical contacts which, when the ink pen is positioned within a printer, engage with corresponding contacts in the printer to allow electrical connection of the ink-jets to the control system of the printer. In this manner, the printer control system can selectively actuate the ink-jets to print desired images. Ink pens are generally replaceable so that when the supply of ink within the reservoir is depleted or the print head malfunctions, the ink pen can be removed from the printer, discarded, and a new pen inserted into the printer.

As can be appreciated ink pens are delicate instruments which must be protected to ensure proper operation. For instance, the tiny orifices of the ink-jets can become plugged or damaged as a result of the accumulation of dust and dirt. This problem is exacerbated because of the abundant amount of dust and small paper fibers that exist in most printing environments. These materials may build up on the print head and clog the ink-jets or may enter an orifice and contaminate the ink within the orifice or the well.

Vapor loss may also cause an ink pen to malfunction. Ink is a combination of many different components, some of which evaporate more readily than others. As a result, prolonged exposure of the ink to the ambient atmosphere may cause the easily evaporated components to evaporate while the other components remain. This selective evaporation can alter the composition of the ink to the point where the ink pen can no longer function properly. In extreme cases, the ink within the orifice may thicken or solidify, thereby plugging the orifice.

An ink pen may also become inoperable if the electrical contact pad is scratched or if the contacts become obscured with dirt. If the contacts are damaged or obscured, the continuity of the electrical connection between the printer control system and the ink-jets may be broken. This may prevent the proper actuation of the affected ink-jet and require replacement of the entire pen.

In addition, ink pens are vulnerable to damage from the discharge of static electricity. A static electrical charge may build up while the ink pen is in service within a printer. This accumulated static charge may discharge when the ink pen comes into contact with a conductive material, either within the printer, during ink pen removal from the printer, or while the ink pen is out of the printer. Such a discharge can seriously damage the sensitive electrical circuits associated with the print head and the contact pads, as well as the orifices on the print head.

Thus, to ensure the reliable and efficient operation of an ink pen, it is desirable to protect the sensitive print head and electrical contact pad at all times. In some existing ink pens, the print head is covered with tape during the manufacture of the pen. The tape serves as a vapor barrier to limit vapor loss or evaporation of the ink and covers the print head to help prevent contamination of the print head and ink-jets during shipment and initial storage of the ink pen. However, the tape is removed and discarded prior to placing the ink pen within a printer. As a result, the print head and ink-jets may be left unprotected and without an adequate vapor barrier during use and during any subsequent storage of the ink pen.

Some printers are provided with built-in capping stations. During printing operations, the printer typically moves the ink pen back and forth over the printing medium to print the desired images. When the ink pen is not in service, the printer moves the ink pen to the capping station where the print head and ink-jets are shielded. However, over time such permanent capping stations can become dirty or wear out. If this occurs, the capping stations no longer perform properly and docking an ink pen at such a capping station may even contribute to the contamination of the print head. Moreover, such built-in capping stations may become obsolete as ink pen designs change.

Special storage containers, or ink pen garages, are also available to protect ink pens. However, to place the ink pen within the ink pen garage, the ink pen must be removed from the printer. Consequently, the ink pen must then be removed from the garage and replaced within the printer for use. As a result, the use of such containers is inconvenient and in many circumstances impractical.

SUMMARY OF THE INVENTION

Accordingly, it is an object of the present invention to provide a protective capping apparatus for an ink pen that protects the print head, the electrical contacts, or both, from contamination and damage.

Another object of the invention is to provide a protective capping apparatus for an ink pen that protects the print head, the electrical contacts, or both, against damage caused by the discharge of static electricity.

A protective capping apparatus in accordance with one aspect of the present invention has a protective cap attached to an ink pen and movable between an open position and a closed position. In the closed position the protective cap shields a portion of the ink pen to protect it from damage by the ingress of dirt and debris, the accumulation or solidification of ink, the discharge of static electricity or the like.

In one aspect of the invention, the protective cap can pivot between the closed position and the open position and is positioned such that in the closed position the cap protects the ink-jets of a print head.

In another aspect of the invention, the protective cap is slidable between the closed position and the open position and is positioned such that in the closed position the cap shields the print head, the electrical contacts, or both.

In yet another aspect of the invention, the protective cap wipes the print head and/or the electrical contacts when the protective cap moves between the closed and open positions.

Other objects and aspects of the invention will become apparent to those skilled in the art from the detailed description of the invention which is presented by way of example and not as a limitation of the present invention.

BRIEF DESCRIPTION OF THE DRAWINGS

FIG. 11 is a partially exploded perspective view of a print head having a protective capping apparatus in accordance with another preferred embodiment of the present invention.

FIG. 12 is a cross sectional view taken along line 12—12 in FIG. 11.

FIG. 13 is a partial side view of a print head having a capping mechanism in accordance with another preferred embodiment of the present invention.

DESCRIPTION OF THE ILLUSTRATED EMBODIMENTS

Figure 1:
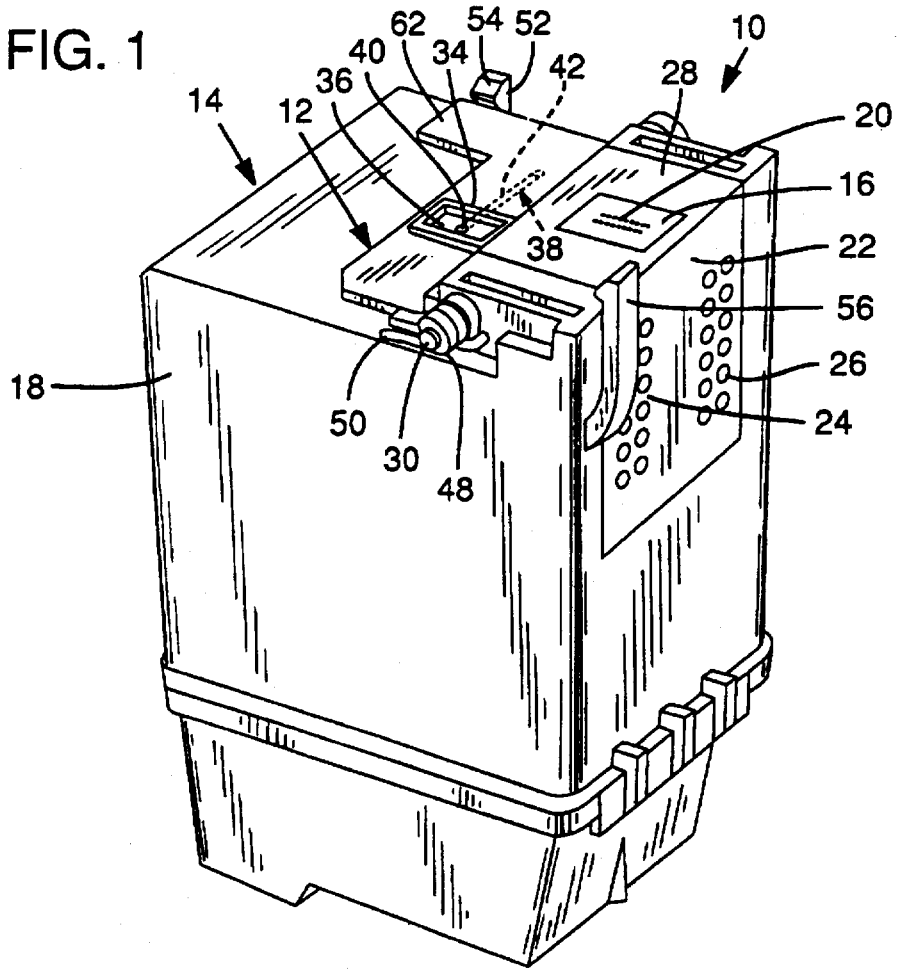
FIG. 1 is a perspective view showing the bottom and sides of an ink pen having a protective capping mechanism in accordance with a preferred embodiment of the present invention.

An ink pen capping device in accordance with a preferred embodiment of the present invention is designated in FIG. 1 with reference numeral 10. The illustrated capping device includes a cap 12 pivotably mounted to the lower end of an ink pen 14. The cap can be pivoted from an open position to a closed position. In the closed position, the cap covers sensitive portions of the ink pen to shield them from damage and to limit the ingress of dust, paper fibers, and other contaminants.

Figure 2:
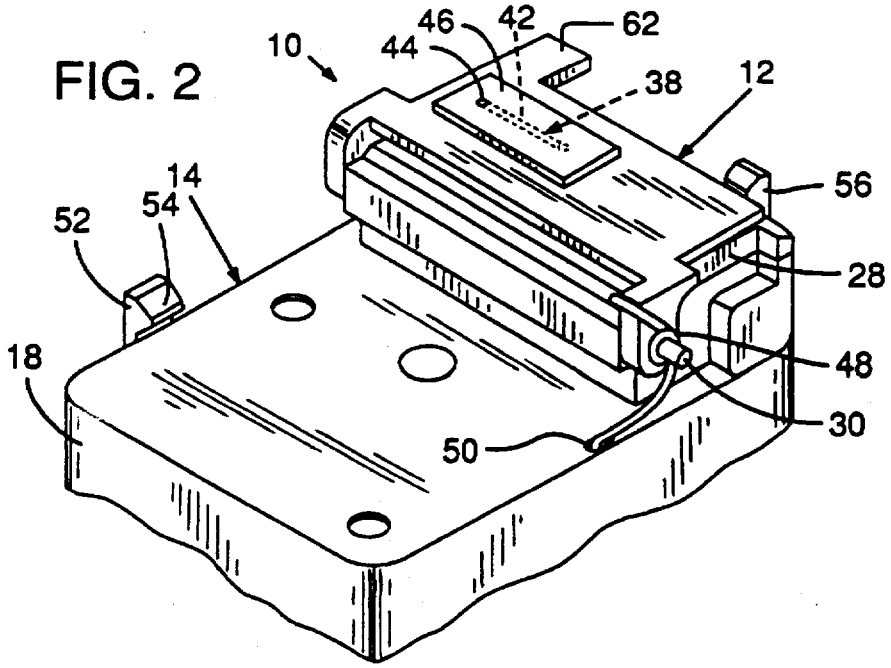
FIG. 2 is a partial perspective view of the protective capping apparatus of FIG. 1 in a closed position.

As seen in FIGS. 1 and 2, the capping device 10 is situated on an ink pen 14. The illustrated ink pen 14 has a reservoir 18 for holding a supply of ink. A print head 16 is in fluid communication with the reservoir 18. The print head 16 is provided with an array of ink-jets 20 each of which can be selectively actuated, by providing an electrical signal to the ink-jet, to eject ink and form desired characters and images.

A flexible strip conductor 22 extends from the print head 16 and terminates in a contact pad 24 which is fixed to one side of the reservoir 18. The contact pad 24 has an array of exposed electrical contacts 26. The strip conductor contains a number of electrical leads extending from the electrical contacts 26 to circuitry associated with the ink-jets 20. When the ink pen 14 is positioned within a printer (not shown) these electrical contacts 26 engage corresponding contacts on the printer. In this manner, the control system of the printer can selectively actuate any given ink-jet 20 by providing an electrical signal to the appropriate contact or contacts.

In embodiment illustrated in FIGS. 1 and 2, the print head 16 is mounted on a support platform 28 which extends from the bottom of the ink pen 14. A pivot post 30 extends laterally from each side of the support platform 28. Each pivot post 30 is received in a corresponding aperture formed in the cap 12. In this manner, the cap 12 is pivotably fixed to the ink pen 14.

The cap 12 can pivot about the post 30 between an open position, shown in FIG. 1, and a closed position, shown in FIG. 2. As illustrated, the ink pen 14 and cap 12 are configured such that, in the open position, the cap 12 fits compactly against the bottom of the ink pen 14 where it does not interfere with the operation of the ink pen or printer. In the closed position, the cap 12 covers the print head 16 to shield it from potentially damaging contact with foreign objects and to limit the ingress of dirt, paper fibers, and other damaging contaminants into the ink-jets 20. The cap 12 also protects the print head from damage from electrostatic discharge.

In the illustrated embodiment, the effectiveness of the cap 12 is enhanced by providing a gasket 34 on the cap 12. As best shown in FIG. 1, the gasket 34, which is preferably an elastomeric material, is positioned on the cap 12 such that when the cap 12 is in the closed position the gasket abuts the print head 16 to define a protective chamber 36 about the ink-jets 20 without requiring the cap 12 to be in contact with the sensitive and easily damaged ink-jets 20. The protective chamber 36 serves as a humidity or vapor barrier to help maintain a high humidity within the chamber 36 and prevent any ink within the ink-jets 20 from evaporating or solidifying. This configuration also reduces the possibility that any debris or contaminants which might build up around an ink-jet 20 while the cap 12 is in the open position will be forced into the ink-jet when the cap is closed.

In some embodiments, it may be desirable to provide a vent 38 for the chamber 36 to help maintain an equilibrium between the air pressure inside the chamber 36 and the ambient. In the embodiment of FIG. 1 and 2, the cap has a vent 38 with an internal opening 40 within the chamber 36. A diffusion channel 42 extends from the internal opening 40 through the cap 12 to an external opening 44. The vent 38 acts to prevent an air pressure spike within the protective chamber 36 from forcing air into an ink jet. At the same time, the vent preserves the humidity or vapor barrier.

In the embodiment of FIGS. 1 and 2, the internal opening 40 extends completely through the cap 12 and the bottom of the diffusion channel 42 is defined by a trough formed on the outer surface of the cap 12. A cover 46 is placed over the trough to seal the top of the diffusion channel 42. The external opening 44 extends through the cover 46 and opens into the diffusion channel 42.

While the illustrated vent 38 with the elongated diffusion channel 42 advantageously serves to inhibit evaporation and solidification of ink within the ink-jets, it should be understood that alternative venting schemes may also be used. For example, in alternative embodiments, the vent may be a hole extending directly through the cap 12 and into the chamber 36.

In some embodiments, it may also be desirable to position an absorbent member (not shown) on the inner surface of the cap 12. The absorbent member can absorb ink spilled from the ink-jets during shipping and ink remaining on the print head after printing. Thereby, such accumulated ink is prevented from collecting contaminants or solidifying and blocking the ink-jets. Such an absorbent member could also help to maintain a humid environment around the ink-jets to prevent ink within the nozzles from evaporating or solidifying. Such an absorbent member could be used either in combination with a gasket or without a gasket.

In the embodiment illustrated in FIGS. 1 and 2, a torsion spring 48 is provided to urge the cap 12 into the closed position. One end of the torsion spring 48 engages the cap 12 and the other end engages a recess 50 in the ink pen 14. The centrally located coil of the torsion spring 48 surrounds one of the pivot posts 30 to help maintain the spring 48 in the proper position. In this manner, the torsion spring 48 serves to bias the cap toward the closed position and ensure that the cap is maintained firmly in its protective position when in the closed position.

Of course, it should be appreciated that other types of springs or biasing devices may work equally as well as the torsion spring 48 illustrated in FIGS. 1 and 2. Moreover, in some embodiments, it may not be necessary or desirable to have such a biasing device.

Indeed, some embodiments of this invention may include manual opening and closing of the protective cap by the operator of the printer. Other embodiments may include printer-based actuator mechanisms that move the protective cap between the open and closed positions with or without pen-based biasing devices.

As seen in FIGS. 1 and 2, the illustrated embodiment includes a latch 52 to hold the cap 12 in the open positions. The latch 52 has an overhanging protuberance 54 extending therefrom. In FIG. 1, the latch 52 is positioned such that when the cap 12 is in the open position, the protuberance 54 engages a tab 62 extending from the cap 12 to maintain the cap in the open position. The latch 52 flexes outwardly to allow the cap 12 to be moved into or out of the open position. A similar latch 56 can be provided to help maintain the cap 12 in the closed position. As shown in FIG. 2, latch 56 engages the edge of the cap 12 to maintain the cap in the closed position. It is to be understood that other latch types can be used with equally good results. Moreover, the latches may not be required in embodiments where biasing devices hold the cap in position, or where printer-based actuator mechanisms hold the cap in position.

Figure 3:
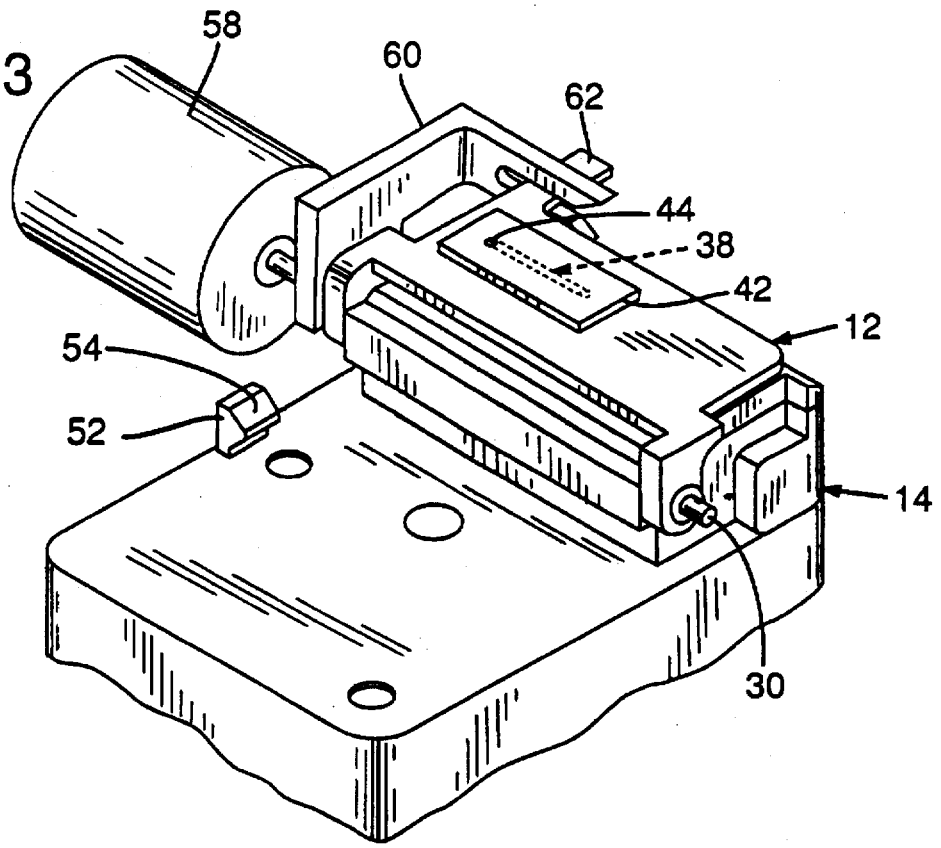
FIG. 3 is a partial perspective view showing the bottom of an ink pen having a protective capping apparatus in accordance with an alternative preferred embodiment of the present invention.
Figure 4:
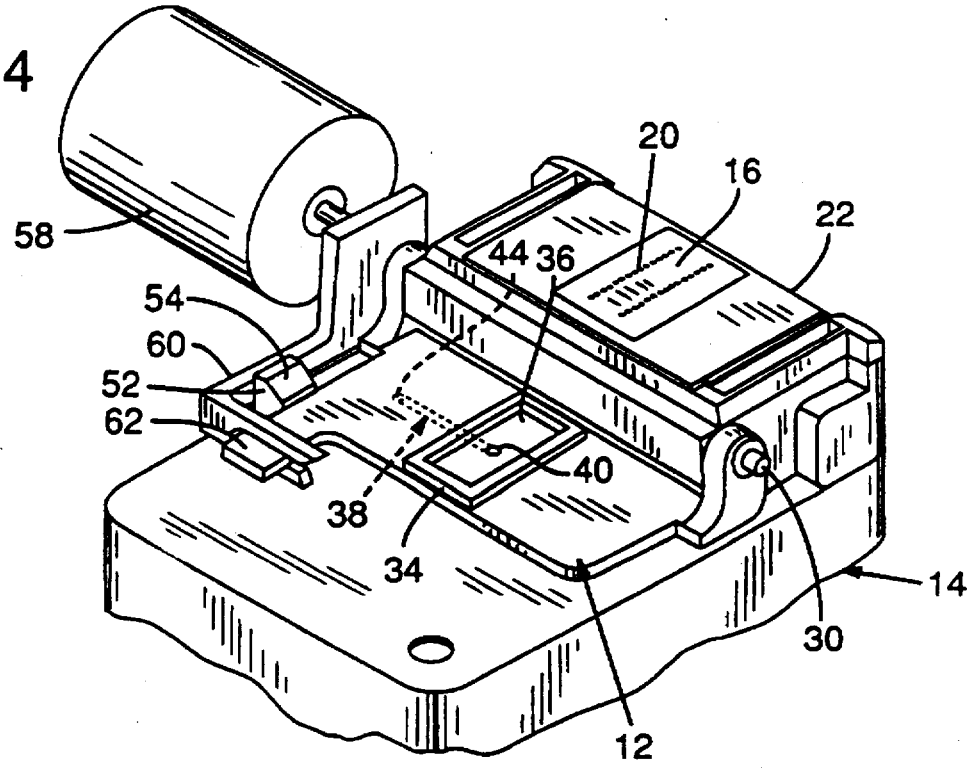
FIG. 4 shows the protective capping mechanism of FIG. 3 in an open position.

There are several possible mechanisms for moving the cap 12 from the open position to the closed position. For example, as illustrated in FIGS. 3 and 4, a motor 58 could be used to actuate the cap 12. In the embodiment illustrated in FIGS. 3 and 4, the motor is provided with a forked actuator 60 which engages a tab 62 formed on the cap 12. In this manner, the motor can be driven in one direction to open the cap and in the other direction to close the cap.

Although the motor may be mounted directly to the ink pen carriage, in the illustrated embodiment, the motor is mounted adjacent a home station of the ink pen within the printer. When the printer is not printing, the ink pen 14 is normally moved to the home station where the forked actuator 60 engages the tab 62 to allow the motor 58 to move the cap 12 to the closed position. Upon activation of the printer, the motor 58 moves the cap 12 to the open position and the ink pen 14 is moved from the home station, thereby disengaging the tab 62 from the forked actuator 60.

In the embodiment of FIGS. 3 and 4, the cap is maintained in the open position during printing operations by means of a latch 52. When at the home station, the cap can be held in the closed position by the motor. Alternatively, a latch or a spring could be provided to hold the cap in the closed position.

Figure 6:
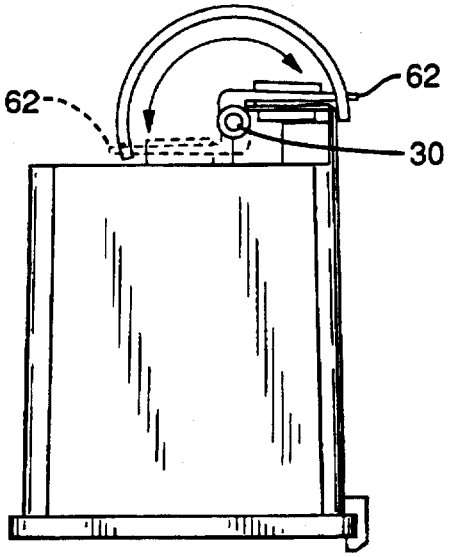
FIG. 6 is a side view taken along line 6—6 in FIG. 5.
Figure 5:
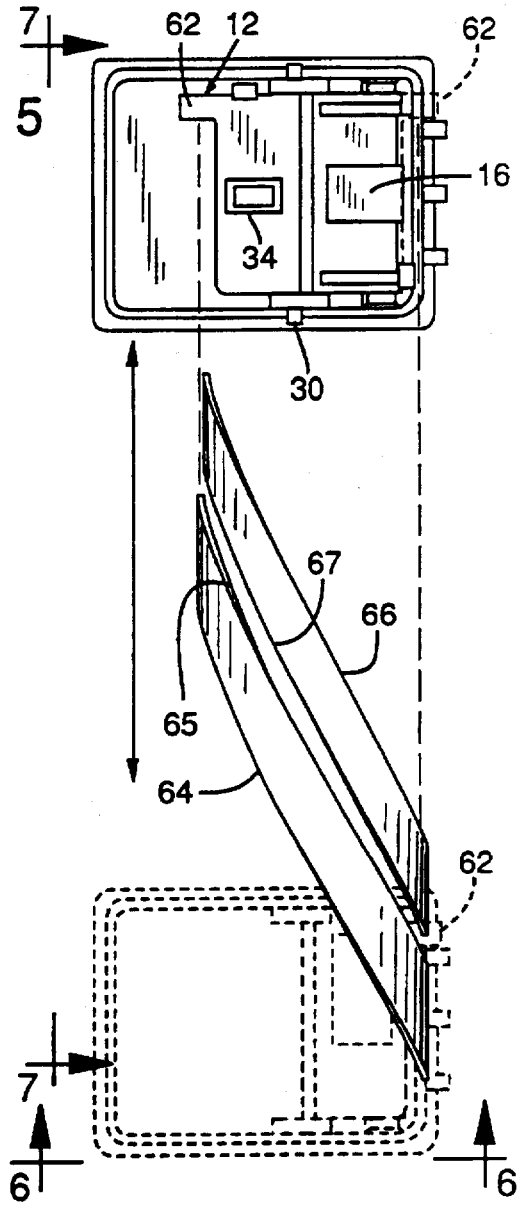
FIG. 5 is a bottom plan view of ink pen having a protective capping apparatus in accordance with another preferred embodiment of the present invention and a set of cam ramps for actuating the protective capping apparatus. The ink pen with the capping apparatus in the open position is shown in phantom.
Figure 7:
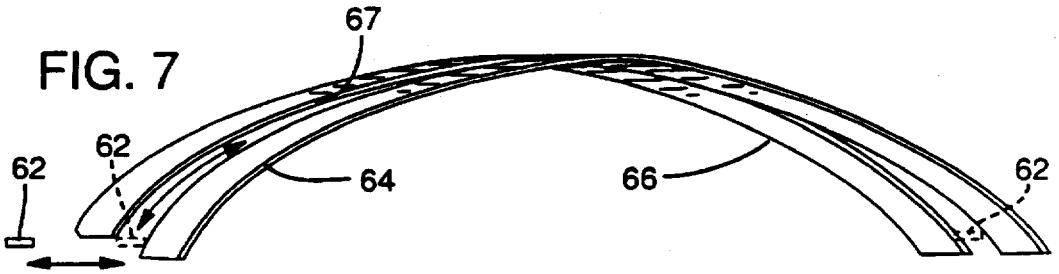
FIG. 7 is a side view of the cam ramps taken along line 7—7 in FIG. 5.

FIGS. 5–7 illustrate an alternative mechanism for moving the cap 12 between the open position and the closed position. In this mechanism, two cam ramps 64 and 66 are situated within a printer (not shown) such that as the ink pen 14 is moved along the cam ramps 64 and 66 they engage the tab 62 to move the cap 12 into either the closed position or the open position, depending on the direction of movement.

Each cam ramp 64 and 66 is a band or wire having the general shape of a half of a revolution of a spiral. In the illustrated embodiment, the cam ramps 64 and 66 are positioned adjacent one another and next to the home station of the ink pen 14. In this manner, as the ink pen 14 is moved into the home station (illustrated in phantom in FIG. 5) the tab 62 engages an edge 65 of cam ramp 64. Further lateral movement of the ink pen 14 causes the tab 62 to follow the edge 65 of the cam ramp 64 to thereby move the cap 12 into the closed position.

Conversely, as the ink pen 14 is moved from the home position, the tab 62 engages an edge 67 of cam ramp 66. Further movement of the pen causes the tab 62 to follow the edge 67 of the cam ramp 66, thereby moving the cap 12 into the open position. The cap can be held in the open or closed position by latches, springs, or other similar devices.

Although a motor-driven actuator, biasing members, and tab engaging cam ramps have been illustrated as providing a mechanism for moving the cap between the open and closed positions, it should be appreciated that a variety of different, yet equivalent, structures could be used to perform this function.

Figure 8:
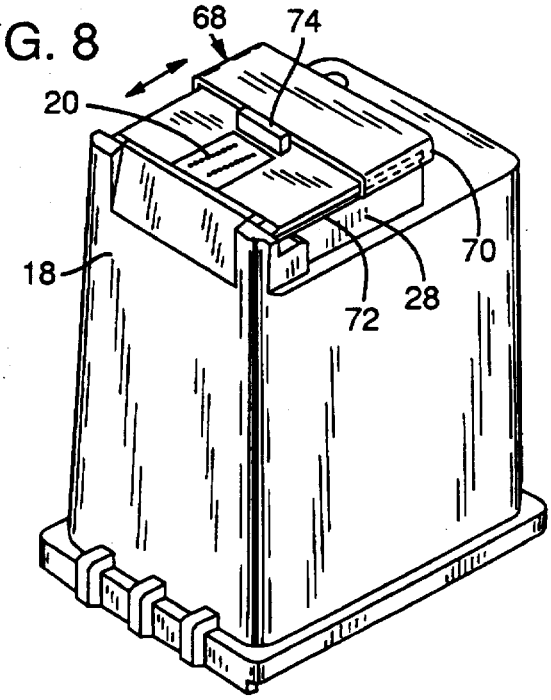
FIG. 8 is perspective view of an ink pen having a protective capping apparatus with a wiper in accordance with another preferred embodiment of the present invention.

FIG. 8 shows another preferred embodiment of a protective capping apparatus in accordance with the present invention. This embodiment has a sliding cap 68 which slides between an open position in which the ink-jets 20 are exposed and a closed position in which the ink-jets 20 are covered. The sliding cap 68 is provided with legs 70 which are slidably received within guide tracks 72 formed on each side of the support platform 28.

An elastomeric gasket (not shown) can be positioned on the sliding cap 68 to form a protective seal around the ink-jets 20 when the sliding cap 68 is in the closed position. This seal acts as a vapor barrier to help prevent the solidification of the ink resulting from evaporation. A wiper 74 can also be provided. The wiper 74 is positioned so that as the sliding cap 68 moves between the open position and the closed position, it wipes across the surface of the ink-jets 20 to remove any dirt, debris or accumulated ink.

Figure 9:
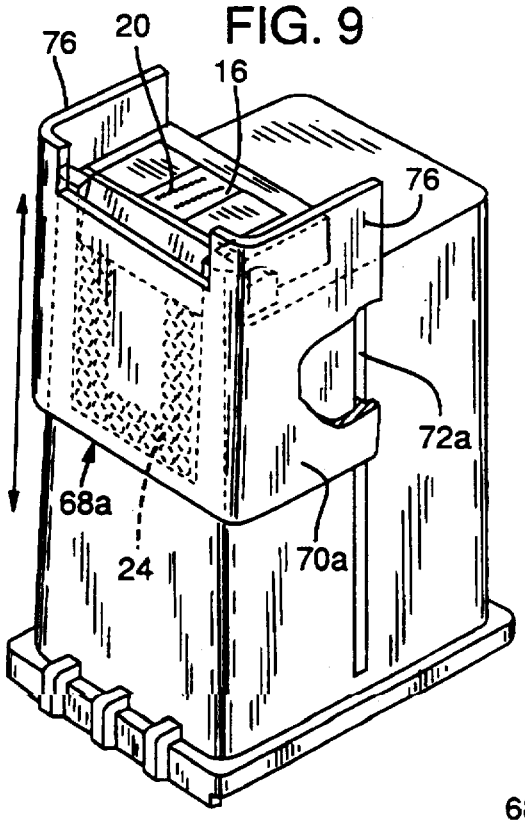
FIG. 9 is a partially cut-away perspective view showing the bottom and sides of an ink pen having a capping apparatus in the closed position in accordance with another preferred embodiment of the present invention.
Figure 10:
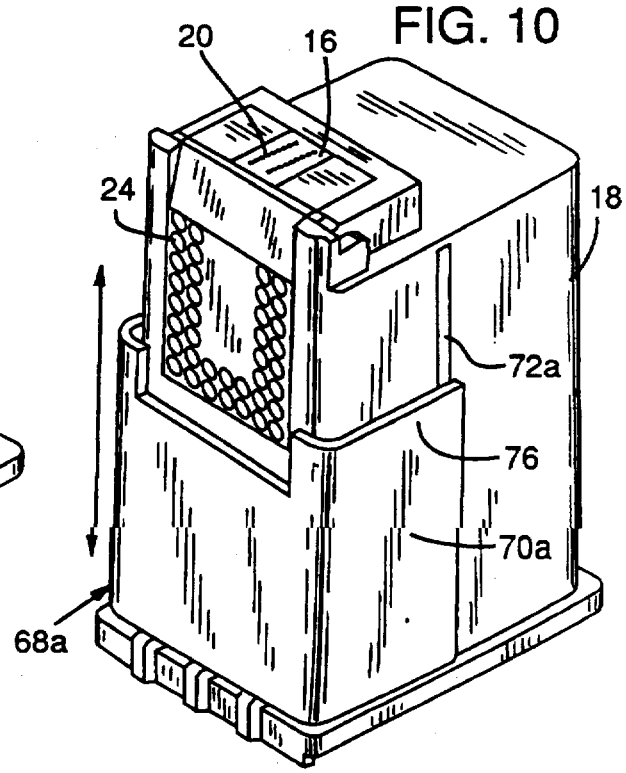
FIG. 10 shows the protective capping apparatus of FIG. 9 in an open position.

FIGS. 9 and 10 show an alternative embodiment in which a sliding cap **68*a* is positioned to slide between an open position in which the contact pad 24 is exposed and a closed position in which the contact pad 24 is covered. Sliding cap 68*a* has legs 70*a* that engage guide tracks 72*a* formed in the side of the ink reservoir 18. The sliding cap 68*a* can be provided with extensions 76 which, when the sliding cap is in the closed position, extend beyond the end of the ink pen to shield the print head 16** from direct contact with foreign objects.

It may be desirable to electrically insulate the sliding cap **68*a* from the contact pad 24 and to form an electrical path from the sliding cap 68*a* to the ink pen 14. This will help shield the contact pad 24 from damage caused by the discharge of static electricity. In a similar manner, the extensions 76 of the slider cap 68*a* help prevent the print head 16 from coming into direct contact with foreign objects to protect it against damage from static electrical discharge from the print head 16**.

Alternatively, the slider caps 68, **68*a* may be made of non-conductive material and still help electrically insulate the print head and/or contact pad 24** from static electrical discharge. It is also to be understood that the electrical insulation feature may be applied to all embodiments of the protective capping apparatus, including the pivotable print head cap embodiments of FIGS. 1–6. Non-conductive caps, or conductive caps having conductive pathways to the ink pen to electrically insulate the print head, work equally well with the embodiments.

FIGS. 11–13 show a protective capping mechanism for a page wide print head 78. The illustrated page wide print head 78 has a curved front surface 80 with a number of ink-jets formed therein. A protective cap 82 is pivotable between a closed position in which it shields the front surface 80 and an open position in which the front surface 80 is exposed. The protective cap 82 is provided with a leg 84 at each end. An aperture 86 in each leg 84 is received on a pivot post 88 extending from the page wide print head 78. In this manner, the protective cap can pivot between the closed position and the open position.

In the embodiment illustrated in FIG. 12, a gasket 90 is positioned on the protective cap 82 to form a protective chamber 91 around ink-jets on the front surface 80. A wiper 92 is positioned so as to wipe across the front surface to remove any accumulated dirt, debris or excess ink. The position of the pivot posts 88 and the length of the legs 84 can be varied to achieve a desired movement of the gasket and wiper across the front surface. For example, if the pivot posts 88 are positioned at the center of curvature of the front surface, as shown in FIGS. 11 and 12, the wiper and the gasket will wipe across the entire front surface.

However, it may be desired that the pivot posts are offset slightly from the center of curvature of the front surface 80 so that the gasket tends to lift from the front surface as the protective cap is pivoted. In the embodiment shown in FIG. 13, the pivot posts (not shown) of the cap **82*b* are offset (in the direction of the open position) from the center of curvature of the front surface 80**.

To provide for the wiping of the front surface 80, a spring-biased wiper arm 94 is rockably positioned upon the protective cap **82*b*. The wiper arm 94 has a ledge 96 which extends over the longitudinal edge of the cap opposite the direction of the open position. A wiper 92*a* is attached to protrude from the ledge 96 and extend longitudinally along the front surface 80. A biasing member 95 urges the wiper 92 into contact with the front surface 80. In a preferred embodiment, the biasing member 95 is a compression spring that interconnects the cap 82*b* and the wiper arm 94 opposite the ledge 96. The spring 95 is compressed when the cap is in the closed position. As the cap opens, the gasket 90 lifts from the front surface 80, while the spring 95 expands to urge the wiper 92 into sweeping contact with the front surface 80**.

This embodiment has advantages when, for example, the gasket material is not suitable for wiping, or when an absorbent member not suitable for wiping is installed on the cap. It should be understood that the wiper arm 94 may be biased in a variety of ways. For example, a torsion spring similar to the torsion spring 48 in FIGS. 1 and 2 may be used. Alternatively, a tension spring positioned adjacent the ledge 96 may be used to urge the wiper 92 into contact with the front surface 80.

It should be appreciated that protective cap mechanisms in accordance with the present invention may be actuated by a variety of suitable mechanisms. The motor and actuating arm illustrated in FIGS. 3 and 4 and the cam ramps illustrated in FIGS. 5–7 are only two of many such mechanisms. Clearly variations of these mechanisms as well as other mechanisms will be apparent to those skilled in the art.

Moreover, the illustrated print heads all have thermal ink-jets. However, it should be appreciated that a capping device in accordance with the present invention may be used beneficially with other types of ink-jets or with other types of print heads.

This detailed description is set forth only for purposes of illustrating examples of the present invention and should not be considered to limit the invention in any way. Clearly, numerous additions, substitutions, and modifications can be made to these examples without departing from the scope of the invention which is defined by the appended claims and their equivalents.

We claim:

1. An ink pen assembly comprising:

an ink pen having a print head and at least one exposed electrical contact on the exterior of the pen and a cap attached to and carried by the ink pen, the cap having an open position and a closed position and being slidable on the ink pen along a straight path between the open position and closed position, in which the cap shields the electrical contact.

2. The ink pen assembly of claim 1 wherein the ink pen has an exterior surface and the print head is on the exterior surface, the exterior surface having guide tracks formed therein adjacent the print head, and the cap including legs for engaging the guide tracks on the ink pen to guide the cap between the open and closed positions.

3. An ink pen assembly comprising:

an ink pen having a print head;

a cap mounted to the ink pen, the cap having an open position and a closed position, and movable between the open position and the closed position in which the cap covers a least a portion of the print head; and a resilient latch mounted to the ink pen and having a protuberance which engages the cap when the cap is in one of the open position and the closed position to maintain the cap in the one position, the latch resiliently flexible to permit the cap to move past the protuberance out of the one position when a selected force is applied to the cap; and wherein at least a portion of the cap is made from a conductive material to electrically couple the cap to the ink pen in the open position and the closed position.

4. A system for protecting an ink pen having a print head, comprising:

an ink pen having a print head;

a cap attached to the ink pen and movable between an open position and a closed position in which the cap shields a portion of the print head;

a wiper arm mounted to the cap and having a ledge protruding beyond the cap;

a wiper mounted to the ledge to wipe over at least a portion of the print head when the cap moves between the open and closed positions; and a biasing member situated between the wiper arm and the cap, the biasing member engaging the wiper arm to urge the wiper into sweeping contact with the print head as the cap moves from the closed to the open position.

5. A system for protecting a traveling ink pen comprising:

a cap pivotally mounted to and travelling with the ink pen and having an open position and a closed position, the cap pivotable between the closed position wherein the cap shields a portion of the ink pen and the open position; and a cam ramp located near the cap in a fixed position to engage the cap as the cap travels with the ink pen to move the cap between the open and closed positions.

6. A system for protecting a traveling ink pen comprising:

a cap pivotally mounted to and traveling with the ink pen and having an open position and a closed position, the cab pivotable between the closed position wherein the cap shields a portion of the ink pen and the open position; and a cam ramp located near the cap in a fixed position to engage the cap as the cap travels with the ink pen to move the cap between the open and closed positions and wherein the cam ramp has a part that engages the cap, and the part defines a cam path having a shape of a portion of a revolution of a helix.

7. An ink pen assembly having an electrical contact pad for contact with electrical contacts on a printer, the ink pen assembly comprising:

an ink pen having an exterior surface and an electrical contact pad exposed thereon for contact with the electrical contacts on the printer; and a cap having an open position and a closed position and being movable between the open position and the closed position in which the cap covers at least a portion of the electrical contact pad.

8. The ink pen assembly of claim 7 wherein the cap is made at least partially from a non-conductive material to electrically insulate the cap from the electrical contact.

9. The ink pen assembly of claim 8 wherein the cap has a conductive path to the ink pen to electrically couple the cap to the ink pen.

10. The ink pen assembly of claim 9 wherein the protective cap slides between the open position and the closed position.

11. The ink pen assembly of claim 10 wherein the ink pen has a print head and wherein the protective cap is provided with extensions which shield the print head when the cap is in the closed position.

12. An ink pen assembly comprising:

an ink pen having a print head; and a cap pivoted to the ink pen and having first and second opposing substantially planar surfaces, a closed position in which the first surface overlies at least a portion of the print head, and an open position in which the second surface overlies a portion of the ink pen that is away from the print head, the cap flipping through about 180° between the closed and open positions.

13. The ink pen assembly of claim 12 further comprising a gasket attached to the cap and positioned to form a vapor barrier around the print head when the cap is in the closed position.

14. The ink pen assembly of claim 13 further comprising a vent disposed through the cap to maintain an air pressure equilibrium from the ambient through the vapor barrier.

* * * * *